US008534110B2

(12) United States Patent
Ghiran et al.

(10) Patent No.: US 8,534,110 B2
(45) Date of Patent: Sep. 17, 2013

(54) METHOD AND APPARATUS FOR TUBE BENDER SET-UP

(75) Inventors: Mike M. Ghiran, Lake Orion, MI (US); Spyros P. Mellas, Waterford, MI (US); William M. Crantas, Highland, MI (US); Kevin R. Marks, Durand, MI (US); Douglas T. Wohlenhaus, Hughesville, MD (US)

(73) Assignee: GM Global Technology Operations LLC, Detroit, MI (US)

( * ) Notice: Subject to any disclaimer, the term of this patent is extended or adjusted under 35 U.S.C. 154(b) by 564 days.

(21) Appl. No.: 12/687,926

(22) Filed: Jan. 15, 2010

(65) Prior Publication Data

US 2011/0174035 A1 Jul. 21, 2011

(51) Int. Cl.

| | |
|---|---|
| ***B21D 9/00*** | (2006.01) |
| ***B21D 9/04*** | (2006.01) |
| ***B21D 7/04*** | (2006.01) |
| ***B21D 9/05*** | (2006.01) |
| ***B21D 55/00*** | (2006.01) |
| ***B21C 51/00*** | (2006.01) |

(52) U.S. Cl.
USPC ..... 72/369; 72/149; 72/155; 72/21.4; 72/21.6; 72/18.2

(58) Field of Classification Search
USPC ..... 72/21.4, 18.2, 149, 154, 155, 17.3, 72/19.8, 369, 159, 157, 153, 156, 158, 21.6
See application file for complete search history.

(56) References Cited

U.S. PATENT DOCUMENTS

| | | | | |
|---|---|---|---|---|
| 3,661,003 | A * | 5/1972 | Heiberger et al. | 72/31.01 |
| 4,587,832 | A * | 5/1986 | Illguth | 72/17.3 |
| 4,738,140 | A * | 4/1988 | Kempf | 73/730 |
| 4,959,984 | A * | 10/1990 | Trudell et al. | 72/154 |
| 5,819,574 | A * | 10/1998 | Yogo | 72/155 |
| 7,594,417 | B1 * | 9/2009 | Ghiran et al. | 72/149 |

* cited by examiner

*Primary Examiner* — Dana Ross
*Assistant Examiner* — Mohammad I Yusuf
(74) *Attorney, Agent, or Firm* — Quinn Law Group, PLLC

(57) ABSTRACT

A method is provided for setting up a tube bender having a bend die, a clamp die, a pressure die and a wiper die. The method includes providing a test-piece having an outer surface defined by a length and a substantially round cross-section. The method also includes arranging the pressure die, the clamp die, and the wiper die relative to each other in the tube bender, and arranging the test-piece relative to the pressure die, the clamp die, and the wiper die. The method further includes applying a force by the tube bender to clamp the test-piece, and determining whether the applied force is within a predetermined range of forces. Additionally, the method includes adjusting the arrangement of at least one of the pressure die, the clamp die, and the wiper die to apply a force to the test-piece that is within the predetermined range of forces.

9 Claims, 3 Drawing Sheets

FIG. 1
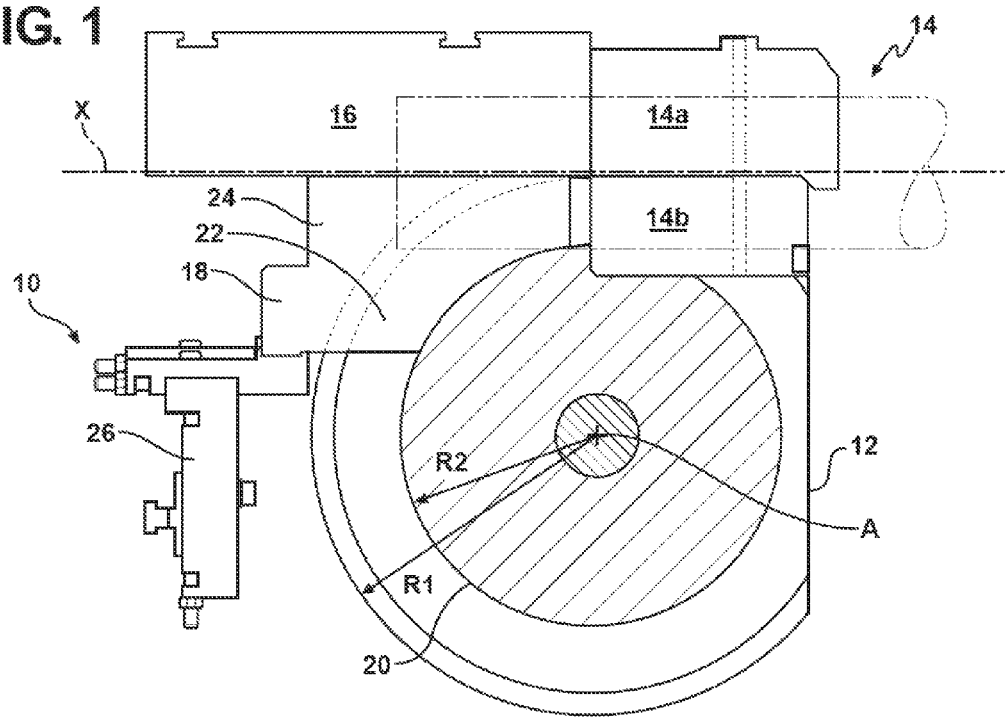
FIG. 2A
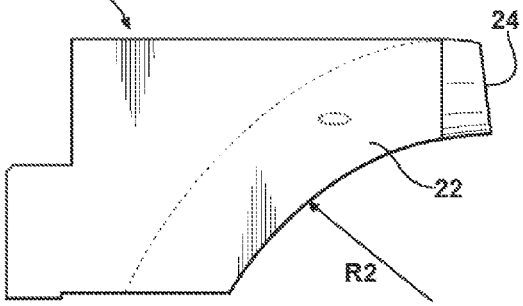
FIG. 2B
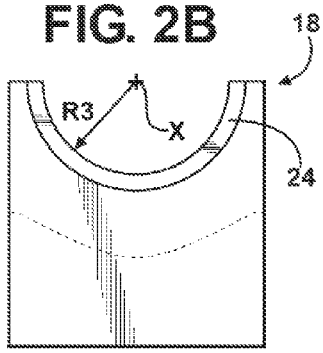
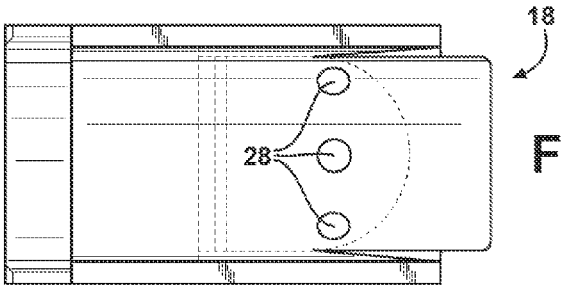
FIG. 2C

METHOD AND APPARATUS FOR TUBE BENDER SET-UP

TECHNICAL FIELD

The present invention relates to tube and pipe bending, and, more particularly, to setting up a tube bender.

BACKGROUND OF THE INVENTION

Horizontal rotary draw bending is a commonly employed method utilizing tube bending machines for bending and shaping metal pipes and tubing. Horizontal rotary draw bending machines typically include a bend die, a pressure die, and commonly also a wiper die for restraining the subject tubing in a particular orientation during the bending operation.

Generally, the wiper die is employed for holding tubing in tension, with the aim of preventing possible wrinkling or creasing of the tube wall due to the stress encountered during the operation. Proper setting of the wiper die, the wiper die's fore and aft position and angular orientation, i.e. rake angle, with respect to a bend die, is highly important to the quality of resultant bent tubing. Traditionally, however, wiper die set-up is an iterative trial and error process, which may lead to production inefficiencies, as well as result in damage to the wiper die itself.

SUMMARY OF THE INVENTION

In view of the foregoing, a method is provided for setting up a tube bender having a bend die, a clamp die, a pressure die and a wiper die. The method includes providing a test-piece having an outer surface defined by a length and a substantially round cross-section. The method also includes arranging the bend die, the clamp die, the pressure die and the wiper die relative to each other in the tube bender, and arranging the test-piece relative to the bend die, the clamp die, the pressure die and the wiper die. The method further includes applying a force to the test-piece by the tube bender to clamp the test-piece, and determining whether the force applied to the test-piece is within a predetermined range of forces. Additionally, the method includes adjusting the arrangement of at least one of the bend die, the clamp die, the pressure die and the wiper die to apply a force to the test-piece that is within the predetermined range of forces.

The method may also include arranging a sensor relative to the outer surface, wherein the sensor is configured to sense application of a force to the test-piece. According to the method, arranging of the test-piece may include clamping the test-piece between the bend die, the clamp die, the pressure die and the wiper die. Determining whether the force applied to the test-piece is within a predetermined range of forces may be accomplished by sensing the force applied to the test-piece via a sensor arranged on the outer surface of the test-piece. Determining whether the force applied to the test-piece is within a predetermined range of forces may be further accomplished by communicating a signal representative of the sensed force to a processor. Determining whether the force applied to the test-piece is within a predetermined range of forces may be additionally accomplished by displaying the force via the processor to thereby compare the sensed force to the predetermined range of forces. Furthermore, determining whether the force applied to the test-piece is within a predetermined range of forces may be accomplished by displaying via the processor a suggested adjustment to the arrangement of at least one of the bend die, the clamp die, the pressure die and the wiper die. Displaying of the suggested adjustment via the processor may be accomplished on a monitor.

An apparatus for performing the above method in a rotary bender for bending a tube is also provided. The apparatus employs a test-piece having an outer surface defined by a fixed length and a substantially round cross-section corresponding to a cross-section of the tube. The apparatus also employs a first sensor array having at least one sensor arranged relative to the outer surface configured to sense forces applied to the test-piece via the bender. The apparatus additionally employs a second sensor array having at least one sensor arranged relative to the wiper die configured to sense the forces applied to the test-piece via the bender. Furthermore, the apparatus includes a processor in electronic communication with the first and the second sensor arrays, wherein the processor is arranged relative to the bender and configured to receive and process electronic signals representing the sensed forces. Additionally, the apparatus may include a monitor in electronic communication with the processor in order to display the sensed forces.

The above features and advantages and other features and advantages of the present invention are readily apparent from the following detailed description of the best modes for carrying out the invention when taken in connection with the accompanying drawings.

BRIEF DESCRIPTION OF THE DRAWINGS

FIG. 1 is schematic illustration of a plan view of a rotary tube bender having a bend die, a clamp die, a pressure die and a wiper die;

FIG. 2A is a schematic illustration of a plan view of the wiper die of the rotary tube bender shown in FIG. 1;

FIG. 2B is a schematic illustration of a front view of the wiper die of the rotary tube bender shown in FIG. 1;

FIG. 2C is a schematic illustration of a side view of the wiper die of the rotary tube bender shown in FIG. 1, shown with an array of sensors positioned on its surface;

DESCRIPTION OF THE PREFERRED EMBODIMENTS

Figure 3A:
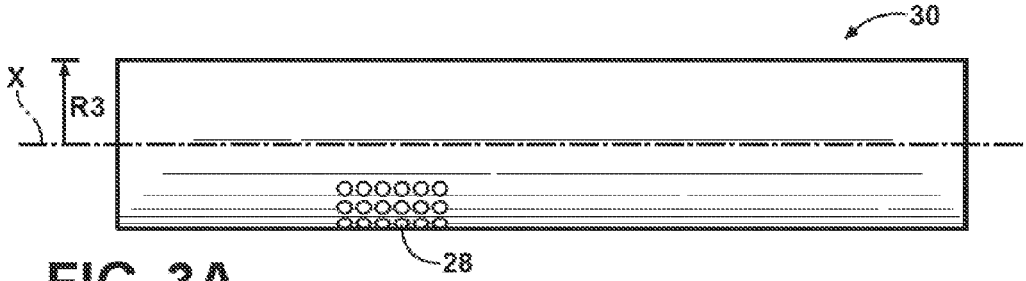
FIG. 3A is a schematic illustration of a plan view of a test-piece having an array of sensors positioned on its surface.
Figure 3B:
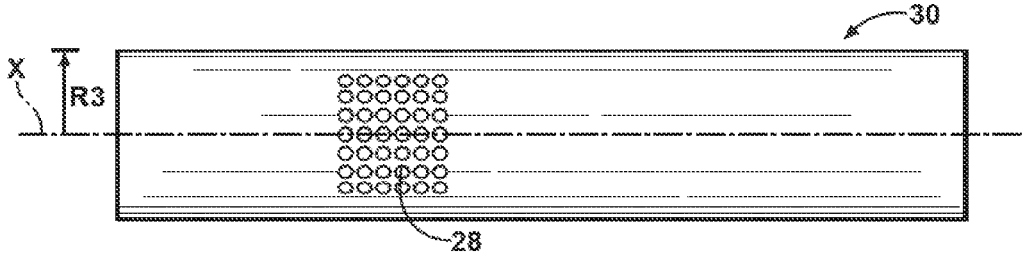
FIG. 3B is a schematic illustration of a side view of the test-piece, shown in FIG. 3A, having an array of sensors positioned on its surface.
Figure 4:
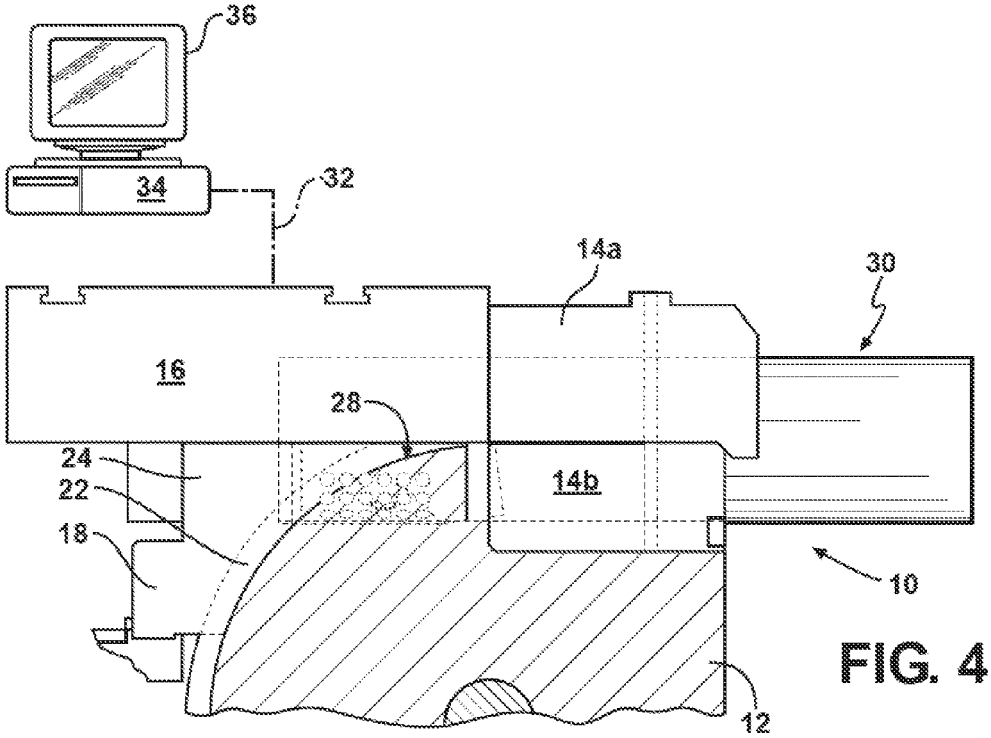
FIG. 4 is schematic partially cut-away illustration of a plan view of the rotary tube bender with the test-piece, shown in FIGS. 3A-B, arranged therein.

Referring to the drawings in which like elements are identified with identical numerals throughout, FIG. 1 illustrates a rotary tube bender 10. The tube bender 10 includes a bend die 12, a clamp die 14, a pressure die 16, and a wiper die 18, as known by those skilled in the art. The tube bender 10 is commonly employed in the metal working industry to generate quality bends of a predetermined radius in pipes or tubes that are typically formed from high strength, but malleable materials such as steel or aluminum.

The bend die 12 has a largely circular shape with an outer radius R1, and is rotationally moveable with respect to an axis A. The bender 10 additionally has a circular guide surface 20 mounted on the axis A, concentrically with respect to the bend die 12. The guide surface 20 has an outer radius R2, with which it serves to position the wiper die 18 in the bender 10. The clamp die 14 mounts relative to bend die 12, and includes a replaceable block 14*a* and an adjustable block 14*b*. The clamp die 14 is configured to move concurrently with the bend die 12 during a pipe bending operation. The pressure die 16 is an adjustable component that moves together with the bend die and clamp die 14 during the pipe bending operation, as understood by those skilled in the art. The pressure die 16 typically includes a controlling mechanism (not shown) that produces a time delay, a.k.a. "boost delay", in the movement of the pressure die with respect to the movement of the bend die 12 and clamp die 14 during the bending operation. Such boost delay is employed to prevent collision between the clamp die 14 and the pressure die 16 during the pipe bending operation.

The wiper die 18 includes a radius R2 (shown in FIG. 2A) which corresponds to the outer radius R2 of the guide surface 20. Wiper die 18 also includes a radius R3 (shown in FIG. 2B) which corresponds to the outer radius of a pipe that is desired to receive a formed bend. During the bending operation, a pipe slides past the wiper die 18. The wiper die 18 functions primarily to keep a pipe in tension during the bending operation, in order to maintain shape and surface quality of the work-piece being subjected to processing stress. The wiper die 18 includes a permanent portion or holder 22, and a wearable and replaceable portion 24. The wearable portion 24 is typically formed from a relatively soft metal alloy, such as brass or aluminum to avoid scratching or damaging the material being bent. The wiper die 18 also typically includes a mechanism 26 for rapid adjustment and repositioning of the wiper die on the bender 10. The wiper die 18 is an adjustable component that, once positioned, remains stationary with respect to non-moving features of the bender 10, as understood by those skilled in the art.

A pipe work-piece is typically installed in the bender 10 by being lain along line X and clamped between block 14*a* and block 14*b* of the clamp die 14. The position of the block 14*a* and block 14*b* is typically adjusted in order to align and restrain the pipe in the bender 10. In order to properly restrain and support the pipe, it is additionally clamped between the pressure die 16 and the wiper die 18, by adjusting the position of the wiper die, as well as, at times, the position of the pressure die. Once the pipe is secured in the bender 10, and the bending operation is initiated, the bend die 12 and clamp die 14 are rotated in tandem about the axis A. While the bend die 12 and clamp die 14 are rotated, the pressure die 16 presses against the wiper die 18, thereby advancing the pipe.

The commencement of motion of the pressure die 16 is delayed briefly relative to the motion of the clamp die 14, to avoid collision between the pressure die and the clamp die during the bending operation. Following the brief delay, however, the pressure die 16 is kept in motion along with the pipe in order to avoid excessive tensile loading on the outside radius of the pipe bend that may cause a rupture. While in motion, the pressure die 16 additionally exerts pressure against the wiper die 18 in order to prevent wrinkling of the pipe surface on the inside of the bend. Throughout the operation, the wiper die 18 remains stationary. Such action of the bender 10 permits the forward part of the pipe that is clamped between blocks 14*a* and 14*b* to be horizontally drawn around the perimeter of the bend die. After the bending operation is completed, the pipe is left with a generally uniform bend having its inside radius correspond to the inner radius of the bend die 12.

During the bending operation, while sliding past the wiper die 18, the work-piece exerts significant stress on the wiper die. The amount of stress experienced by the wiper die 18 is directly related to the positioning of the wiper die in the bender 10, with respect to the bend die 12, the clamp die 14, and the pressure die 16. Consequently, a service life of the wiper die 18, as well as the quality of the bent pipe is directly proportional to the positioning of the wiper die. Typically, however, proper positioning of the wiper die 18 with respect to the bend die 12, the clamp die 14, and the pressure die 16 is a trial and error process, during which the wiper die and/or the work-piece may become damaged by forces applied by the bender 10.

Accordingly, load sensors 28 (shown in FIGS. 2C-4), such as, for example, strain gauges, are employed to sense a force or forces that are applied by the bender 10 to a work-piece during the bending operation. The sensed force data is subsequently used to adjust the positioning of the wiper die 18 with respect to the bend die 12, the clamp die 14, and the pressure die 16. A test-piece 30 is provided having an outer radius R3, corresponding to the radius of the work-piece, that is instrumented with one or more of the load sensors 28. Sensors 28 may also be arranged on the wiper die 18 (shown in FIG. 2C), preferably at the interface between the holder 22 and the replaceable portion 24, to provide additional data regarding the force applied to the test-piece 30. The load sensors, such as strain gauges, may be arranged in an array, in order to effectively determine direction, as well as magnitude of the applied forces (as shown schematically in FIGS. 2C-4).

Thus, the test-piece 30 is employed to sense a force that would be applied to the work-piece during the actual work-piece processing with a particular adjustment of the bender 10. According to the embodiment, test-piece 30 is arranged or set-up in the bender 10 relative to the bend die 12, the clamp die 14, and the pressure die 16, thus being secured by the bender, and then the bender is activated to apply a force to the test-piece. The load sensors 28 sense the applied forces and communicate a signal representing such forces, either via a wired or a wireless connection 32, to an electronic processor 34 (shown in FIG. 4).

The electronic processor is programmed to determine whether the force applied to the test-piece 30 is within a predetermined acceptable range of forces. The predetermined range of forces that is programmed into the electronic processor signifies the conditions required to generate a desired quality bent tube without inflicting damage to the work-piece or to the bending equipment. Such a range of forces is typically predetermined during design and development of the bender 10, the corresponding dies 12-18, and heuristically during test runs with representative tubing.

Accordingly, if the processor 34 determines that the sensed force is outside the predetermined acceptable range of forces, the processor displays on a monitor 36 a suggested adjustment to the positioning of at least one of the bend die 12, the clamp die 14, the pressure die 16 and the wiper die 18 in order to achieve the desired force on the test-piece 30. An operator of the bender 10 is then tasked with performing the adjustment of the appropriate dies 12-18 according to the monitor display. Following the adjustment, the test-piece may be processed by the bender 10 once again, in order to verify that the adjustment was successful. If the adjustment is verified, an actual work-piece may then be processed through the bender 10. If, on the other hand, the processor determines that the sensed force falls within the predetermined acceptable range of forces, the processor displays a message to such effect, thereby signifying that an actual work-piece may be processed through the bender 10.

Figure 5:
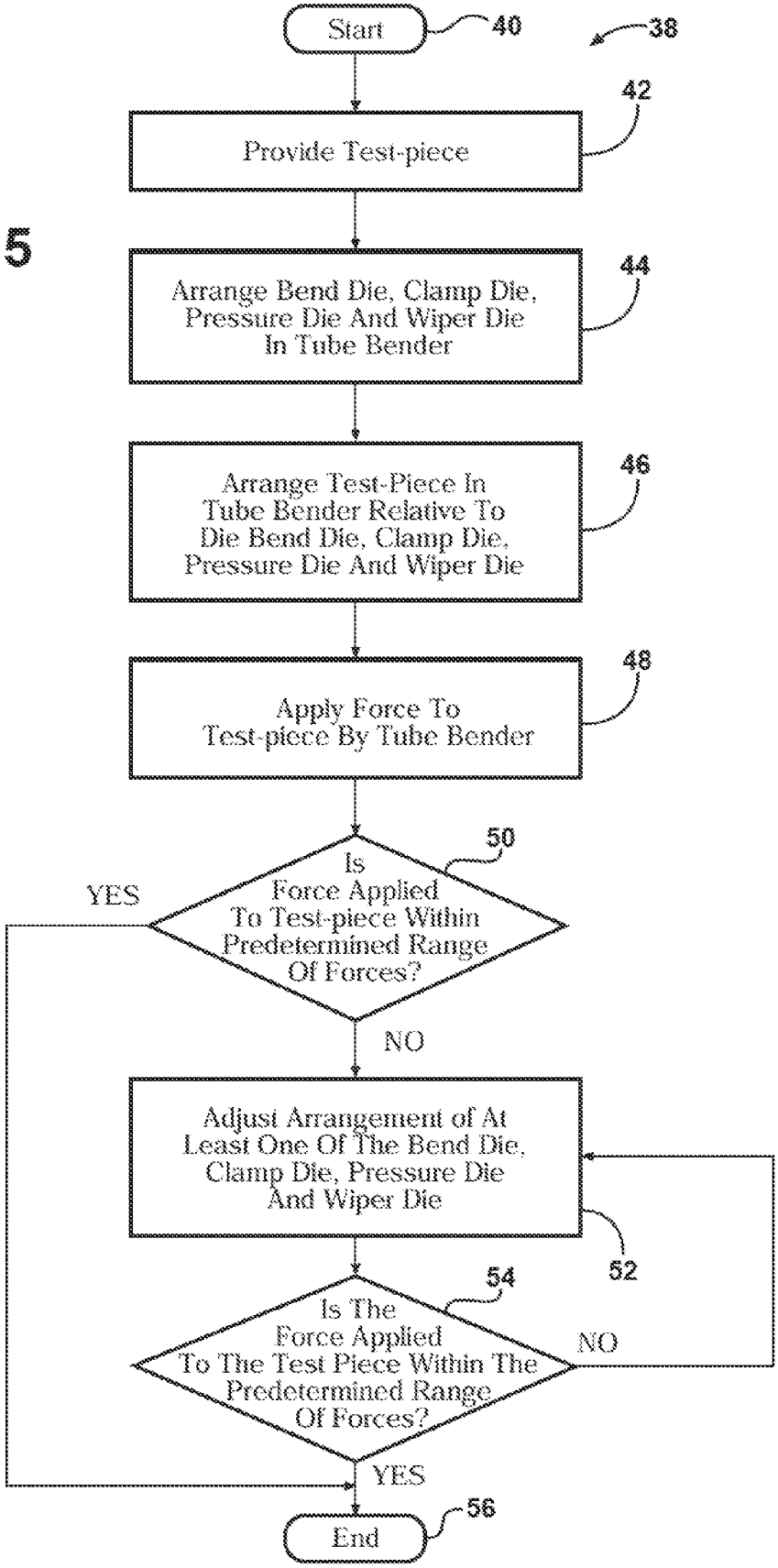
FIG. 5 schematically illustrates, in flow chart format, a method for setting up the tube bender by employing the test-piece shown in FIGS. 3A-B.

FIG. 5 depicts a method 38 for setting up the tube bender 10, described above with reference to FIGS. 1-4. The method 38 is initiated in frame 40, and then proceeds to frame 42, where the test-piece 30 with load sensors 28 is provided. From frame 42, the method proceeds to frame 44, where the bend die 12, the clamp die 14, the pressure die 16 and the wiper die 18 are arranged and adjusted in the bender 10. From frame 44, the method proceeds to frame 46, where the test-piece 30 is arranged in the bender 10 relative to the bend die 12, the clamp die 14, the pressure die 16 and the wiper die 18. The method then proceeds to frame 48, where a force is applied to the test-piece 30 by the bender 10.

Following frame 48, the method proceeds to frame 50 where it is determined by the processor 34 whether the force applied to the test-piece 30 is within the predetermined range of forces, as described above with respect to FIG. 4. If in frame 50 it is determined that the force is outside the predetermined range of forces, the method proceeds to frame 52. In frame 52, according to the method a recommendation is displayed on the monitor 36 as to the adjustment required to the bender 10 in order to bring the forces within the predetermined acceptable range. At this point, an operator of the bender is tasked with performing the required adjustments.

From frame 52, the method proceeds to frame 54 where the test-piece 30 is used to verify whether the adjustment to the bender 10 has been successful. If the adjustment to the bender 10 was not successful, the method will return to frame 52 in order to repeat bender adjustment. If, on the other hand, the adjustment to the bender 10 was successful, the method may display on the monitor 36 that the bender is properly set-up, and will proceed to frame 56, where the method is completed.

If in frame 50 it is determined that the force is within the predetermined range of forces, the method may display on the monitor 36 that the bender 10 is properly set-up, and proceed directly to frame 56, where the method is completed. Following the proper set-up of the tube bender 10, an actual pipe work-piece may be processed. The method and the apparatus, therefore, enable the tube bender 10 to generate consistent, quality bent pipes and tubing without damaging or prematurely wearing out the wiper die 18.

While the best modes for carrying out the invention have been described in detail, those familiar with the art to which this invention relates will recognize various alternative designs and embodiments for practicing the invention within the scope of the appended claims.

The invention claimed is:

1. A method for generating a bend in a tube by a rotary draw tube bender having a bend die, a clamp die, a pressure die and a wiper die, the method comprising:

providing a test-piece having an outer surface defined by a length and a substantially round cross-section substantially identical to that of the tube;

arranging the bend die, the clamp die, the pressure die and the wiper die relative to each other in the tube bender;

arranging the test-piece in the tube bender relative to the bend die, the clamp die, the pressure die and the wiper die;

applying a first force by the tube bender to clamp the test-piece;

determining whether the first force applied to clamp the test-piece is within a predetermined range of forces;

adjusting the arrangement of at least one of the bend die, the clamp die, the pressure die and the wiper die to apply a second force to clamp the test-piece that is within the predetermined range of forces;

verifying that the second force applied to clamp the test-piece is within the predetermined range of forces;

arranging the tube in the bender; and generating the bend.

2. The method of claim 1, further comprising arranging a sensor on one of the tube bender and the outer surface, the sensor configured to sense application of the first and second forces to the test-piece.

3. The method of claim 1, wherein said arranging the test-piece includes clamping the test-piece between the bend die, the clamp die, the pressure die and the wiper die.

4. The method of claim 1, wherein said determining whether the first and second forces applied to the test-piece are within a predetermined range of forces is accomplished by sensing the first and second forces applied to the test-piece via a first sensor arranged on the outer surface of the test-piece.

5. The method of claim 4, further comprising arranging a second sensor on the wiper die, and wherein said determining whether the first and second forces applied to the test-piece are within a predetermined range of forces is additionally accomplished by sensing the first and second forces applied to the test-piece via the sensor arranged on the wiper die.

6. The method of claim 5, wherein said determining whether the first and second forces applied to the test-piece are within a predetermined range of forces is further accomplished by communicating a signal representative of the sensed first and second forces to a processor.

7. The method of claim 6, wherein said determining whether the first and second forces applied to the test-piece are within a predetermined range of forces is further accomplished by displaying the first and second forces via the processor to thereby compare the sensed first and second forces to the predetermined range of forces.

8. The method of claim 7, wherein said determining whether the first and second forces applied to the test-piece are within a predetermined range of forces is further accomplished by displaying via the processor a suggested adjustment to the arrangement of at least one of the bend die, the clamp die, the pressure die and the wiper die.

9. The method of claim 8, wherein said displaying via the processor the suggested adjustment is accomplished on a monitor.

* * * * *